US005445019A

United States Patent [19]

Glidewell et al.

[11] Patent Number: 5,445,019

[45] Date of Patent: Aug. 29, 1995

[54] INTERNAL COMBUSTION ENGINE WITH ON-BOARD DIAGNOSTIC SYSTEM FOR DETECTING IMPAIRED FUEL INJECTORS

[75] Inventors: John M. Glidewell, Dearborn; Granger K. Chui, Dearborn Heights; Woong-Chul Yang, Ann Arbor, all of Mich.

[73] Assignee: Ford Motor Company, Dearborn, Mich.

[21] Appl. No.: 47,905

[22] Filed: Apr. 19, 1993

[51] Int. Cl.[6] ..... F02M 65/00

[52] U.S. Cl. ..... 73/119 A; 123/387

[58] Field of Search ..... 73/119 A, 49.7; 123/387, 494

[56] References Cited

U.S. PATENT DOCUMENTS

| | | | |
|---|---|---|---|
| 3,919,885 | 11/1975 | Kareit . | |
| 4,257,260 | 3/1981 | Beatson et al. . | |
| 4,261,209 | 4/1981 | Hatsuno et al. . | |
| 4,696,275 | 9/1987 | Kushi et al. . | |
| 4,791,810 | 12/1988 | Old et al. . | |
| 4,899,713 | 2/1990 | Nakamura . | |
| 4,930,482 | 6/1990 | Kako . | |
| 4,977,872 | 12/1990 | Hartopp | 73/119 A X |
| 5,020,362 | 5/1991 | Hart et al. . | |
| 5,058,547 | 10/1991 | Morikawa | 73/119 A X |
| 5,211,150 | 5/1993 | Anzai . | |
| 5,218,941 | 6/1993 | Suzuki et al. | 123/494 X |

FOREIGN PATENT DOCUMENTS

| | | |
|---|---|---|
| 0501459 | 9/1992 | European Pat. Off. . |
| 588263 | 6/1981 | Japan . |
| 5594428 | 2/1982 | Japan . |
| 56105821 | 1/1983 | Japan . |
| 61290218 | 6/1988 | Japan . |
| 61295866 | 6/1988 | Japan . |
| 1389408 | 4/1975 | United Kingdom . |
| 2245382 | 1/1992 | United Kingdom . |

*Primary Examiner*—Herbert Goldstein
*Assistant Examiner*—Joseph L. Felber
*Attorney, Agent, or Firm*—Peter Abolins; Roger L. May

[57] ABSTRACT

The present invention is directed to an on-board diagnostic system for detecting impaired fuel injectors in an internal combustion engine during engine operation. A fuel injector control means is provided for individually actuating fuel injectors operatively connected to a fuel rail. Pressure sensor means are mounted to the fuel rail for sensing transient fuel pressure waves resulting from actuation of the individual fuel injectors. Signal processing means are provided for processing pressure signals from the pressure sensor means. The output signal from the signal processing means corresponds to the fuel flow rate through the fuel injectors. Such output signal can be used to alert an engine operator to an impaired fuel injector and/or can be provided to the fuel injector control means for adjusting the duration of injector actuation to achieve a desired fuel flow quantity per individual actuation.

13 Claims, 4 Drawing Sheets

INTERNAL COMBUSTION ENGINE WITH ON-BOARD DIAGNOSTIC SYSTEM FOR DETECTING IMPAIRED FUEL INJECTORS

INTRODUCTION

The present invention is directed to a diagnostic system for an internal combustion engine to detect impaired fuel injectors. More specifically, the invention is directed to an on-board diagnostic system for detecting impaired fuel injectors during engine operation.

BACKGROUND OF THE INVENTION

It has long been the practice to dismantle an internal combustion engine to determine the condition of its components. It is becoming increasingly desirable, however, to provide on-board diagnostic means for components which have a major impact on certain critical engine performance criteria. This is particularly true in the motor vehicle industry, where high precision in the control of fuel flow has become essential to various present and planned engine management features designed to meet increasingly strict emissions, performance, drivability, and maintenance objectives. Thus, it is now well known how to adjust the fuel flow to the cylinders of an engine to maintain desired fuel/air mixture ratio for meeting engine emission requirements by electronically controlling the actuation timing and duration of the engine's fuel injectors. Electronic fuel injector controls are presently available and in use, especially in the engines of more advanced motor vehicles. The control function may be incorporated into an electronic engine control (EEC) module performing a variety of engine control functions. In accordance with such known systems, the timing of injector actuation is controlled by the timing of the corresponding actuation signal sent by the control module. The duration of injector actuation, during which fuel is passed through the injector from a fuel rail or like fuel supply means, is controlled by the duration of the actuation signal from the control module, that is, by the pulse width of the signal.

Reliably controlling a fuel injector's fuel supply by controlling its actuation signal pulse width requires that the fuel injector be performing at or near its specified flow rate when open. A fuel injector may become clogged, however, over a period of use, potentially resulting in decreased engine efficiency, increased emission of undesirable combustion products, etc. Thus, in support of maintaining the efficacy of electronic engine management devices adapted to control air/fuel ratio by controlling the actuation of fuel injectors, it is now recognized to be highly desirable to provide means for detecting clogged or otherwise impaired fuel injectors. In particular, it is seen to be especially desirable to provide an on-board diagnostic system to periodically test an engine's fuel injectors during engine operation without requiring disassembly of the engine.

SUMMARY OF THE INVENTION

The on-board diagnostic system of the present invention employs analysis of fuel pressure transients initiated by the fuel injection event, that is, by fuel injector actuation. It should be understood that reference herein to actuation of a fuel injector for a controlled actuation period is meant to include the deactuation of the fuel injector at the end of that time period. In accordance with preferred embodiments of the invention, it has been found that such analysis of fuel pressure transients acquired by a single pressure transducer mounted on the engine fuel rail can accurately predict dynamic fuel flow of individual fuel injectors spaced along the fuel rail and so identify impaired fuel injectors.

In accordance with the present invention, an internal combustion engine is provided with an on-board diagnostic system for detecting impaired fuel injectors during engine operation. Such an engine and on-board diagnostic system comprise fuel supply means for supplying liquid fuel under pressure to the combustion cylinders of the engine, including a plurality of fuel injectors operatively connected to a fuel rail. Fuel injector control means are provided for individually actuating the fuel injectors to pass fuel from the fuel rail during a controlled actuation period. Pressure sensor means senses fuel pressure in the fuel rail and generates a pressure signal which varies with the pressure sensed. The pressure sensor means may employ a pressure transducer comprising, for example, a pressure responsive diaphragm exposed to the fuel in the fuel rail and a signal conditioner to generate a continuous analog voltage output signal. The pressure signal from the pressure sensor means will vary with time in response to transient fuel pressure fluctuations in the fuel rail resulting from actuation of each of the fuel injectors. These measurable changes in fuel rail pressure resulting from actuation of each individual fuel injector reliably corresponds to flow rate through that injector. Thus, the change in value of the pressure signal is measured, and the difference value reliably corresponds to fuel flow rate during actuation. In fact, the present invention represents a significant advance in electronic engine control in part for its recognition of the useful correspondence of such measurable transient fuel pressure waves in the fuel rail, especially low-frequency pressure waves, to the actual fuel flow rate of a fuel injector during its actuation and for its presently disclosed means and method of detecting impaired fuel injectors during engine operation using pressure signals corresponding to each measured transient fuel pressure wave.

Signal processing means are provided for processing the pressure signals from the pressure sensor means and for generating an output signal in response thereto. The signal processing means preferably develops an average pressure signal value corresponding to a non-actuation period and an average pressure signal value corresponding to an actuation period. For a typical application of the invention in a motor vehicle engine, the signal processing means may take the average of one hundred signal values taken over a two or three millisecond period for the non-actuation value, and use the same sampling rate over a three to five millisecond period for the actuation value.

In certain particularly preferred embodiments of the invention, the on-board diagnostic system is integrated with adaptive air/fuel control means. In accordance with such embodiments, the actuation period of the fuel injectors may be adjusted as their conditions change with age. Most notably, the adaptive air/fuel control means may increase the actuation period of a fuel injector to compensate for its decreased fuel flow rate as a result of clogging or like impairment. Thus, preferably, an output signal of the signal processing means corresponding to the difference between the actuation value and the non-actuation value (and, hence, to the fuel flow rate through the injector in question, as discussed above) is sent to the fuel injector control means. Since the output signal of the signal processing means corresponds to flow rate through a given injector, the fuel injector control means can rely on the output signal to determine and control fuel flow quantity. That is, the fuel injector control means preferably is adapted to adjust the actuation period of each individual fuel injector based on its fuel flow rate as indicated by the output signal received from the signal processing means, typically by increasing or decreasing the pulse width of its actuation signal to the injector, to yield the desired total fuel flow quantity for each actuation of each injector. Thus, in a preferred embodiment in which a fuel injector becomes clogged, the output signal for that fuel injector from the signal processing means would indicate reduced fuel flow rate, and the fuel injector control means would send actuation signals to that injector having a correspondingly enlarged pulse width to lengthen the actuation period during which the injector is open to pass fuel from the fuel rail.

An operator signal means may be provided for generating a signal to an operator of the engine, for example a motor vehicle driver. Thus, the engine operator may be alerted of an impaired injector and undertake preventive maintenance, such as the use of detergent fuel or the addition of fuel injector cleaning additives.

As noted above, variability of injector fuel delivery due to clogging can significantly degrade the control of exhaust emissions, engine performance, etc. Hence, the detection of flow deterioration due to injector clogging or the like by the on-board diagnostic system of this invention, which is able to carry out such detection during running of the engine, can help control exhaust emissions and engine performance, and can be employed in an adaptive strategy to manage fuel flow in an engine having degraded fuel injector performance. These and other features and advantages of the present invention will be better understood in view of the following detailed description of certain preferred embodiments.

BRIEF DESCRIPTION OF THE DRAWINGS

Certain preferred embodiments are described below with reference to the appended drawings, in which.

DETAIL DESCRIPTION OF CERTAIN PREFERRED EMBODIMENTS

While the present invention is applicable generally to any internal combustion engine burning liquid fuel supplied to fuel injectors via a fuel rail, it is particularly advantageous for gasoline burning multicylinder engines, especially motor vehicle engines. Accordingly, without intending to limit the scope of the invention, the discussion below will focus primarily on gasoline burning motor vehicle engines for which on-board diagnostics of various engine performance characteristics is becoming extremely important. The present invention addresses this need by providing an on-board diagnostic system for detecting impaired fuel injectors. Fuel injector clogging can occur through normal engine use and can cause rough idle and lack of power. The on-board diagnostic system of the invention can detect the onset of injector clogging on a running engine. Preferred embodiments of the on-board diagnostic system of the invention can identify specific impaired injectors, thus avoiding the need to replace the engine's complete set of fuel injectors and/or facilitating remedial action by adaptive fuel injector control means to achieve desired total fuel flow with each injector actuation. As to the latter, more specifically, an output signal from the on-board diagnostic system can serve as an input signal to the electronic engine control (EEC) for adaptive air/fuel ratio control, that is, to enable the EEC computer to adjust injector actuation duration to compensate for reduced flow rate through the injector resulting from clogging or like impairment.

Figure 1:
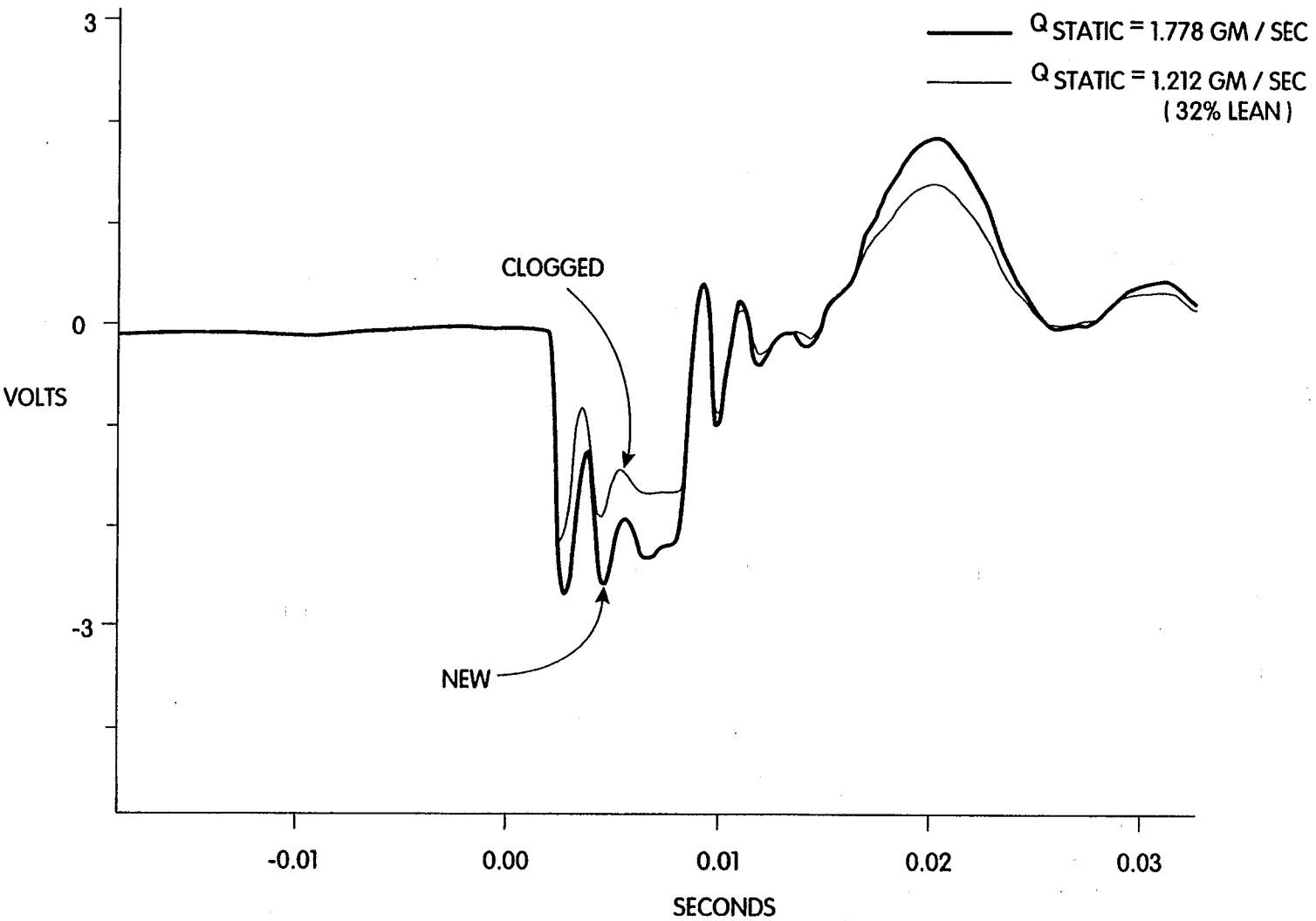
FIG. 1 is a graph illustrating the wave form of output signals generated by a pressure sensor, showing transient fuel pressure waves in a fuel rail resulting from actuation of a clogged fuel injector and a new, unclogged fuel injector, expressed in volts as a function of time.

The graph in FIG. 1 shows pulse waveforms, that is, the output signal from a pressure transducer sensing fuel rail pressure, obtained by testing new and clogged fuel injectors. The graph plots the voltage of the output signal from a pressure transducer mounted to a fuel rail. The pulse waveform was obtained using a pressure transducer having a variable voltage output signal proportional to pressure within the fuel rail. Zero volts corresponds substantially to static equilibrium pressure within the fuel rail (established by a pressure regulator) without fuel injector actuation. Given an actuation commencing at time 0.00 on the graph, pressure in the fuel rail drops at the location of the pressure transducer in response to such actuation after a wave propagation delay period. The output voltage of the pressure transducer is seen to drop correspondingly, and then to recover after the actuation, that is, after the fuel injector is closed. Higher fuel flow rate through the injector results in a greater pressure drop within the fuel rail and, hence, a more negative output voltage during actuation (taking into account the aforesaid wave propagation delay period) from the pressure transducer. It can be seen in FIG. 1 that the pulse waveform resulting from actuation of a clogged fuel injector has a smaller negative voltage value than does actuation of a new, unclogged fuel injector. Identical actuation periods were used for the new and clogged fuel injectors. The difference in pulse waveforms for a new versus a clogged fuel injector has been found to correlate quite well with the quantitative difference in fuel flow rate through the injector during its actuation period.

Figure 2:
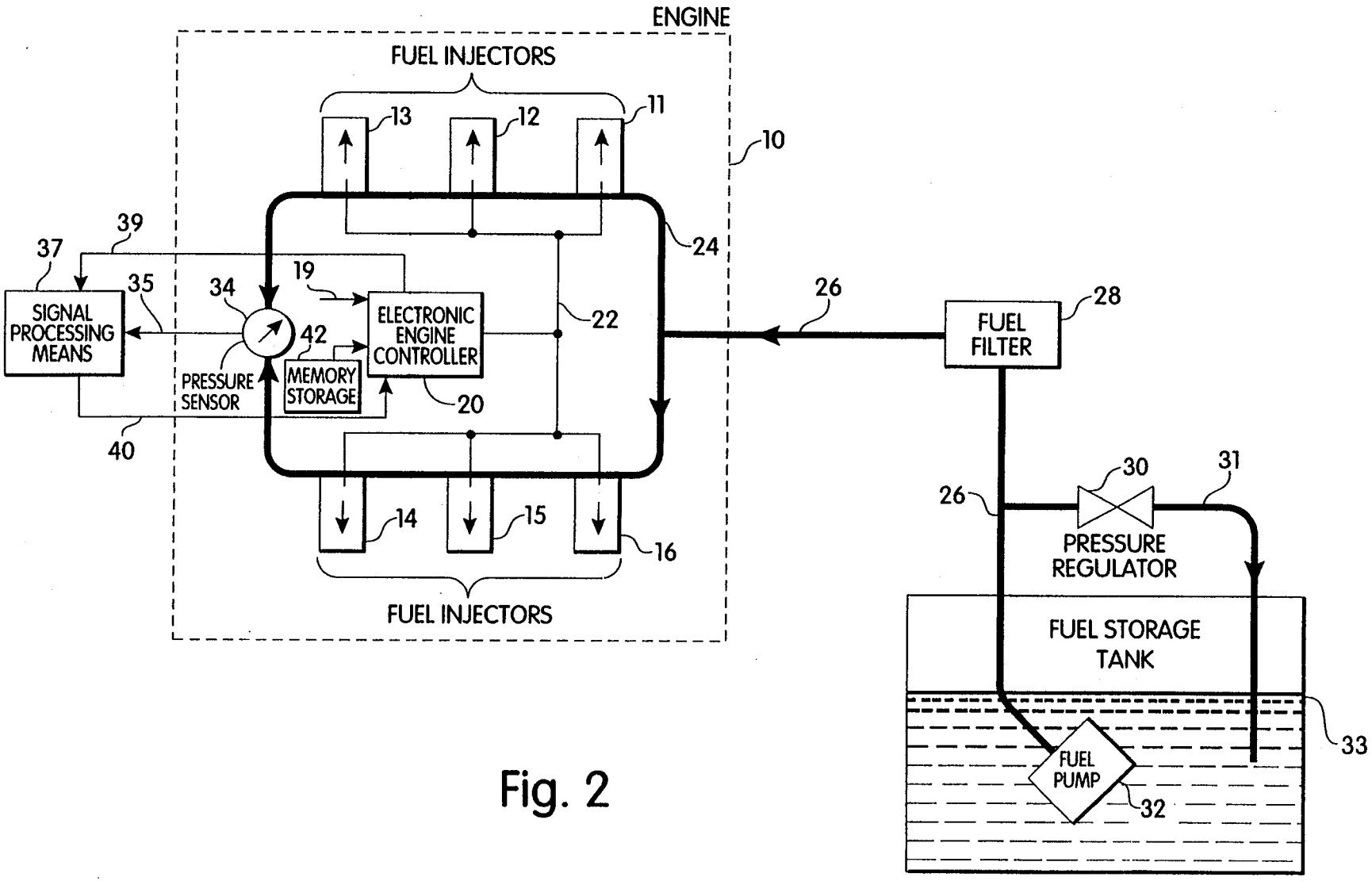
FIG. 2 is a schematic illustration of an internal combustion engine fuel system comprising an on-board diagnostic system for detecting impaired fuel injectors during engine operation in accordance with a first embodiment of the invention.

A first preferred embodiment of the invention is illustrated in FIG. 2, wherein a six cylinder engine 10 is seen to comprise a fuel supply system for supplying gasoline under pressure to the combustion cylinders of the engine. The fuel supply system consists of high pressure electric Gerotor-type pump 32 delivering fuel from a storage tank 33 through an inline fuel filter 28 to a fuel charging manifold assembly 24 via solid and flexible fuel lines. The fuel charging manifold assembly, commonly referred to as a fuel rail, supplies fuel to electronically actuated fuel injectors 11–16 mounted on an air intake manifold directly above each of the engine's intake valves. Air entering the engine is measured by a mass airflow meter. Air flow information and input from other engine sensors 19 is used by an onboard engine electronic control computer 20 to calculate the required fuel flow rate necessary to maintain a prescribed air/fuel ratio for a given engine operation. The injectors, when energized, spray a predetermined quantity of fuel (if they are unclogged) in accordance with engine demand, into the intake air stream. The duration of the actuation period during which the injectors are energized, determined by the actuation signal pulse width, is controlled by the vehicle's EEC computer 20. Thus, the EEC computer serves as the fuel injector control means, and, typically, performs various additional engine control functions.

The fuel injector is an electromechanical device that atomizes the fuel delivered to the engine. Injectors typically are positioned so that their tips direct fuel at the engine intake valves. The valve body consists of a solenoid actuated pintle or needle valve assembly that sits on a fixed size orifice. A constant pressure drop is maintained across the injector nozzles via a pressure regulator. An electrical signal from the EEC unit activates the solenoid, causing the pintle to move inward, off the seat, allowing fuel to flow through the orifice. Thus, the six fuel injectors 11–16 each includes a nozzle assembly which may become clogged and provide reduced fuel flow rate during actuation by its injector driver assembly in response to an actuation signal from the fuel injector control means. An injector would be considered clogged or impaired for purposes of the present invention if it is performing below its intended level, specifically, by passing less fuel to its respective combustion chamber during a given actuation period than would a fully functioning (e.g., new) fuel injector.

In the embodiment of FIG. 2, fuel injector control means 20 has injector signal output means 22 connected to the injector drivers of the fuel injectors 11—16. Injector signals from fuel injector control means 20 control the sequence and timing of fuel injector actuation, including the duration of the actuation period during which each fuel injector, in turn, is open to pass fuel from fuel rail 24 to the respective combustion chamber. A pressure regulator 30 is provided for regulating fuel pressure within fuel supply line 26 and, therefore, in fuel rail 24. Pressure regulator 30 is located proximate to fuel pump 32. That is, it is closer to fuel pump 32 than to the fuel rail 24 and is upstream of the fuel filter 28. Locating the pressure regulator 30 proximate to the fuel pump is found to provide enhanced accuracy of pressure readings by pressure sensor means 34 mounted on fuel rail 24. The fuel pressure regulator typically is a diaphragm operated relief valve with one side of the diaphragm sensing fuel pressure and the other side subjected to intake manifold pressure. The nominal fuel pressure is established by a spring preload applied to the diaphragm. Referencing one side of the diaphragm to manifold pressure aids in maintaining a constant pressure drop across the injectors. Fuel in excess of that used by the engine passes through the regulator and returns to the fuel tank 33 via shunt line 31.

In the preferred embodiment illustrated in FIG. 2, pressure sensor means 34 is mounted to fuel rail 24. Suitable pressure sensor means are commercially available and include, for example, variable reluctance, differential pressure transducers. Preferably the transducer has good transient response to low frequency transient pressure waves, low frequency here meaning 1 KHz or lower. The pressure sensor means preferably also has a high output signal with low susceptibility to electrical noise and good durability to withstand vibrations and shock experienced in a motor vehicle engine environment. Employing pressure sensor means having a transducer diaphragm vented on one side to atmosphere allows gage measurement of pressure (PSIG). The output signal from the pressure transducer preferably is a continuous analog voltage out signal, where signal voltage varies directly with fuel pressure. Zero voltage can be set to the nominal fuel pressure established for the fuel rail. The pressure signal from the pressure sensor means 34 may further comprise signal conditioning means. Thus, the pressure transducer may be connected by a shielded cable to a signal conditioner. Suitable signal conditioners for various suitable pressure transducers are commercially available and will be apparent to those skilled in the art in view of the present disclosure. In accordance with such preferred embodiment, the transducer signal conditioner sources the pressure transducer with excitation power and amplifies the transducer output. The resulting pressure signal, that is, analog voltage output 35 of the pressure sensor means 34 is, therefore, proportional to fuel rail pressure sensed by the pressure transducer.

The pressure signal is input to signal processing means 37 for generating an output signal in response thereto. Signal processing means 37 can be, for example, a programmable waveformanalyzer, various models of which are commercially available and will be readily apparent to those skilled in the art in view of this disclosure. Such analyzers digitize and store analog voltage signals, typically at a rate of about 100 kilosamples per second. The signal processing means preferably is responsive to a timing signal 39 from the fuel injector control means 20 to synchronize acquisition of pressure waveforms with the actuation of the individual injectors. The delay between the sending of the actuation signal and the arrival at the pressure sensor means of the resulting transient fuel pressure waveform is readily obtained empirically for any given application of the invention (i.e., for any given engine arrangement). Those skilled in the art will recognize that such propagation delay will vary from injector to injector, depending on such factors as the distance along a fuel rail between the pressure sensor means and the individual injector. The signal processing means 37 preferably takes multiple values of the pressure signal 35 over an actuation sampling period initiated after the propagation delay time has passed following its receipt of the timing signal 39 from the fuel injector control means 20. Averaging the multiple values sampled during such actuation period yields an actuation value. In accordance with this particular preferred embodiment of the invention, the signal processing means also conducts a non-actuation sampling period. That is it takes multiple values of the pressure signal over a non-actuation sampling period during which the pressure signal from the transducer corresponds to the pressure in the rail substantially unreduced by an injector actuation event. Averaging such multiple values yields a non-actuation value. The signal processing means then generates an output signal 40 to the fuel injector control means 20 based on the difference between the actuation value and the non-actuation value. Without wishing to be bound by theory, it is now understood that the output signal of the signal processing means (essentially a A voltage value in the preferred embodiment discussed above) correlates well to static flow rate through the injector in question and, in turn, the static flow rate correlates well to dynamic flow rate. Thus, the value of output signal 40 from the signal processing means corresponds to the fuel flow rate through the individual injector in question. As the injector becomes clogged the difference between the actuation value and the non-actuation value diminishes.

Typically, the signal processing means will employ a test duration of two to three milliseconds, acquiring 100 sample values of the pressure signal over such test period for determining the non-actuation value. The actuation value preferably is determined over a test period of three to five milliseconds at the same sampling rate used for the non-actuation test period.

The fuel injector control means 20 preferably comprises memory means 42, for example, a look-up table, from which it obtains an adjustment value for a given injector based on the value of the output signal 40 from the signal processing means 37. In accordance with such preferred embodiment, fuel injector control means 20 employs such adjustment means to adjust (i.e., typically increase) the duration of the actuation period for that injector by correspondingly increasing the pulse width of the actuation signal sent to that injector. In this way, an adaptive fuel control system can be achieved, wherein the degree of individual injector clogging is determined and corrective action taken by the engine control computer. Calibration data for the look-up tables or other memory means of the fuel injector control means for determining the adjustment factor for correcting potential injector flow variation can be obtained from end-of-line empirical tests at original engine assembly.

Alternatively, values of the adjustment factor corresponding to incremental degrees of flow rate deterioration can be determined for the look-up table of memory means 42, with sufficient accuracy for many applications, using the following algorithm:

$$AFV = \frac{\beta}{\sqrt{\frac{1}{1 - \frac{\Delta V}{\Phi_{sim} \cdot \alpha}} - 1}}$$

Where:

AFV is the value of the adjustment factor for adjusting (by multiplying) the actuation pulse width and, correspondingly, the duration of the actuation period for a fuel injector;

$\beta$ is a dimensionless constant equal to the volumetric flow rate of the injector (100% unclogged) at the nominal fuel rail pressure, divided by the pump flow rate also at the nominal fuel rail pressure (both of which flow rates are readily measured by routine flow stand tests);

$\Phi_{sim}$ is a dimensionless value which is substantially constant for a given fuel system and nominal fuel rail pressure, being equal to the initial pressure drop from the nominal fuel rail pressure immediately following actuation (allowing for a wave propagation delay period) divided by the steady state pressure drop from the nominal fuel rail pressure upon leaving the injector (100% unclogged) full open with the pressure regulator fixed open at its pre-actuation setting (both of which pressure drops are readily measured by routine flow stand tests);

$\alpha$ is the nominal fuel rail pressure; and $\Delta V$ is the value of the output signal from the signal processing means for a given actuation event, being equal to the measured voltage drop corresponding to the transient pressure drop, with a calibration of 1 PSI/volt.

It should be recognized that the wave form associated with a given injector actuation, as sensed by the pressure sensor means, typically comprises a complex interference pattern generated by the opening and closing events of the injector and their associates echoes propagated in the fuel rail. Without wishing to be bound by theory, it is presently understood that the wave form resulting from each individual injector actuation combines substantially linearly with the waveforms generated by proximate actuations (i.e., injector actuations occurring in close sequential order with the actuation in question). A particularly preferred embodiment of the invention involves injector diagnosis based on a waveform extraction technique now described. The hardware arrangement illustrated in the embodiment of FIG. 2 is suitable for carrying out such a waveform extraction method. In accordance with such method, the fuel injector control means is adapted to actuate the fuel injectors in a standard mode wherein all of the fuel injectors are actuated in turn in a standard engine cycle sequence. The fuel injector control means is further adapted to actuate the fuel injector in a test mode wherein actuation of each of the fuel injectors is deleted in turn from an otherwise standard engine cycle sequence. Thus, there would be a series of otherwise standard engine cycle sequences during each of which a corresponding one of the fuel injectors is not actuated to establish a corresponding test cycle sequence for each individual fuel injector. The pressure signal for actuation of a given fuel injector is then developed by the signal processing means by extracting it from the pressure signal for the standard engine cycle sequence. Specifically, the pressure signal for the test cycle sequence for the injector in question is subtracted or otherwise canceled out of the pressure signal for the standard engine cycle sequence. Because the pressure signals are found to combine substantially linearly, as mentioned above, this operation leaves a pressure signal corresponding substantially to actuation of just the injector in question. In this way, pressure signals for actuation of individual injectors can be obtained while the engine is running. The signal processing means then conducts a sampling period substantially in the manner described above, developing and using the extracted actuation pressure signal for each injector in turn.

Figure 3A:
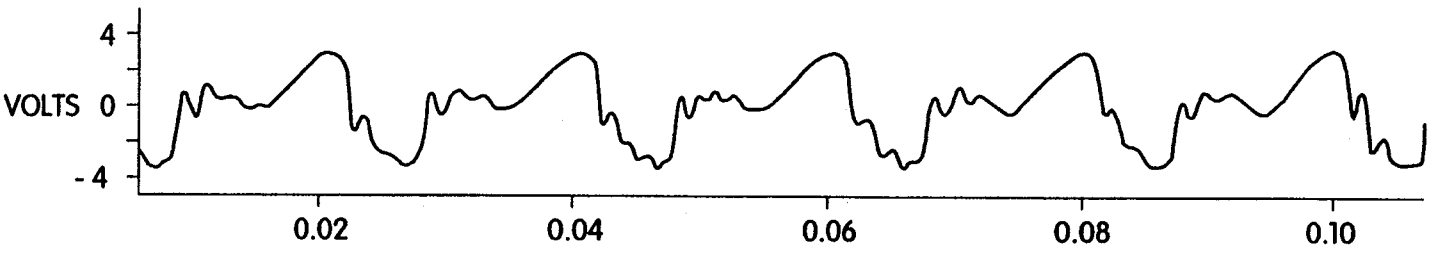
FIGS. 3A, 3B and 3C are graphs illustrating pressure signals generated by the pressure sensor in the embodiment of FIG. 2, based on transient fuel pressure waves in the fuel rail resulting from actuation of fuel injectors during engine operation.
Figure 3B:
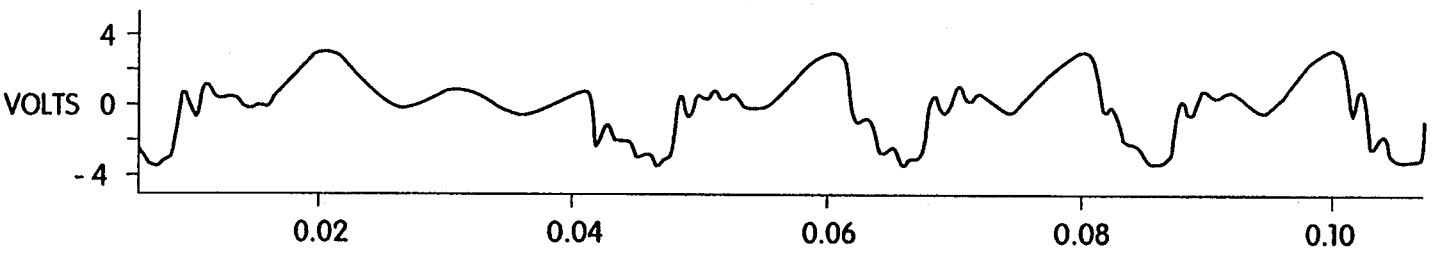
Figure 3C:
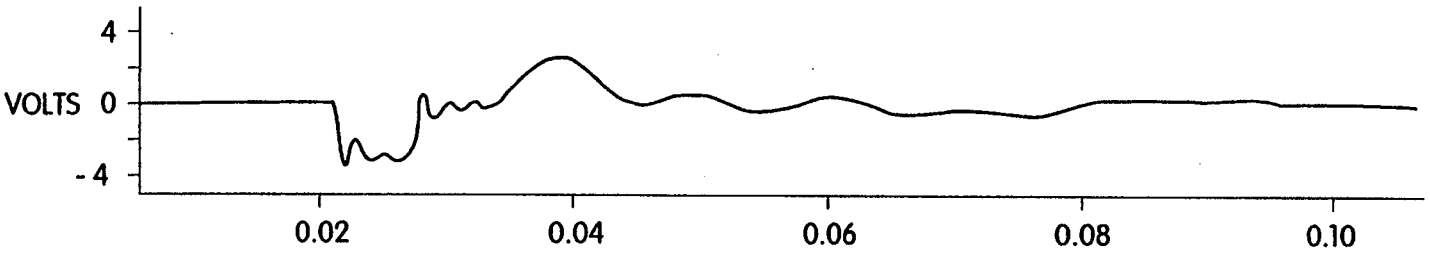

Referring now to FIG. 3, the output signal of the pressure sensor means (in volts) is plotted over time. In FIG. 3A the pressure signal is shown for engine operation in the aforesaid standard mode wherein all of the fuel injectors are actuated in turn in a standard engine cycle sequence. FIG. 3B shows the pressure signal for engine operation in the aforesaid test mode wherein actuation of one fuel injector is deleted from an otherwise standard engine cycle sequence. FIG. 3C shows the extracted wave form for the fuel injector deleted from the test cycle sequence. The wave form of FIG. 3C is obtained by the signal processing means by subtracting the wave form of FIG. 3B from that of FIG. 3A. As previously described, a timing signal from the fuel injector control means to the signal processing means initiates a propagation delay period after which the signal sampling occurs based on the extracted wave form of FIG. 3C. Particularly for motor vehicle applications, it is a highly significant advantage of the extraction method of the present invention that the data necessary for a complete flow analysis of all fuel injectors can be conducted while the engine is running in substantially normal operation, with virtually no effect perceptible by a motor vehicle operator.

Figure 4:
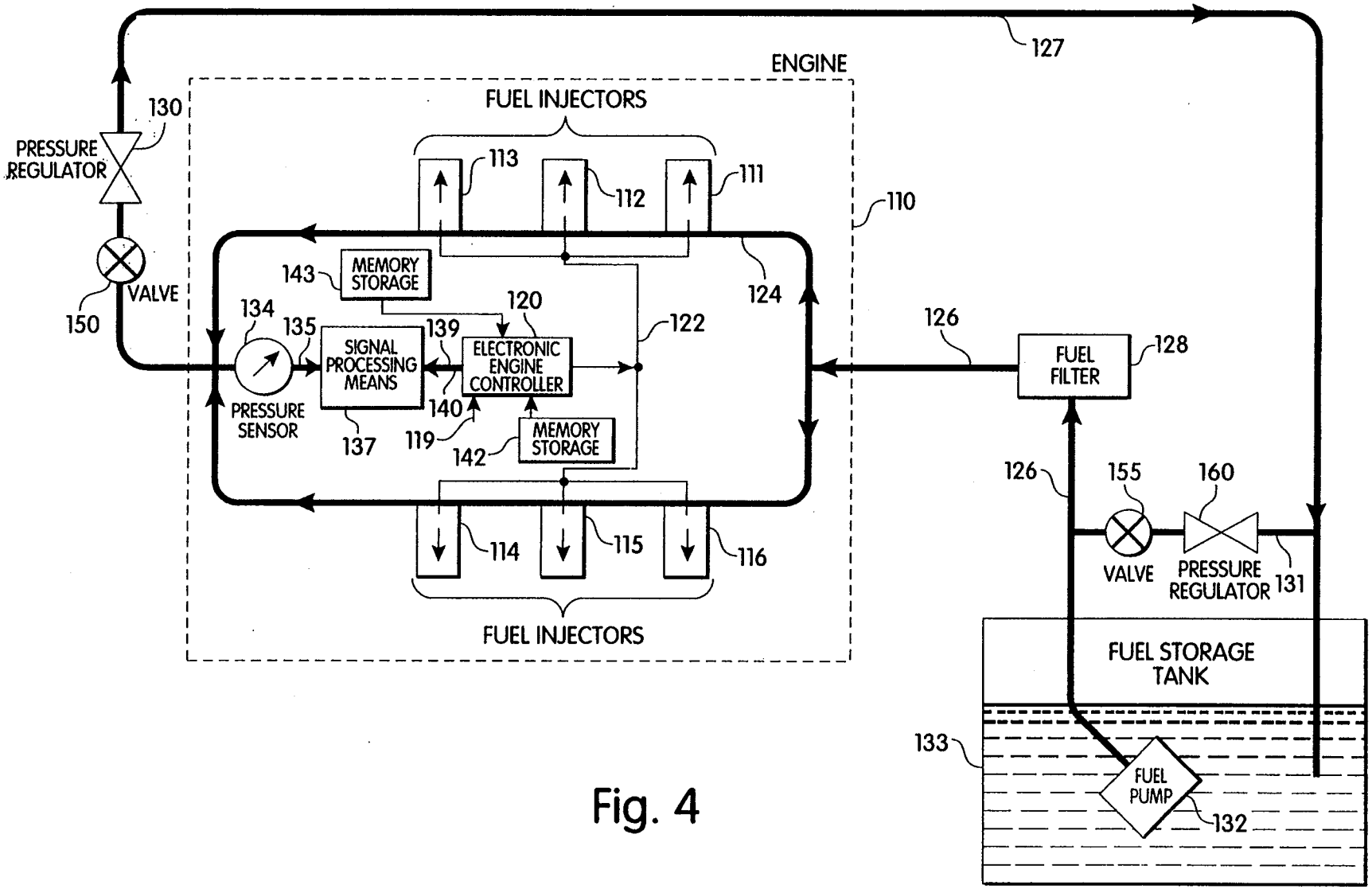
FIG. 4 is a schematic illustration of an internal combustion engine fuel system having an on-board diagnostic system for detecting impaired fuel injectors in accordance with a second embodiment of the invention.

A second preferred embodiment of the invention is schematically illustrated in FIG. 4. The embodiment of FIG. 4 involves a more traditional fuel injection supply line, in that a fuel return line is provided downstream of the fuel rail. The system is modified, however, to deadhead the system during fuel injector testing, as now described. In addition, the pressure regulator is relocated to a location proximate the fuel pump, as in the embodiment of FIG. 2. Suitable regulators are commercially available and will be apparent to those skilled in the art in view of the present disclosure. This embodiment permits fuel pressure to be adjusted to preselected production levels, as in the embodiment of FIG. 2. Locating the regulator remote from the fuel rail can provide individual injector transients in the aggregate waveform having more uniform pulse-to-pulse amplitudes and signatures.

In the embodiment of FIG. 4, fuel pump 132 is mounted in fuel tank 133 in the customary manner. Fuel is supplied during normal engine operation via supply line 126 which passes through fuel filter 128 to fuel rail 124. Fuel rail 124 feeds fuel to 6 fuel injectors 111 through 116 which are actuated by actuation signals 122 from fuel injector control means 120. As in the embodiment of FIG. 2, fuel injector control means 120 preferably is incorporated into an electronic engine control module or computer which performs various additional engine control functions.

Engine 110 in the embodiment of FIG. 4 is adapted for normal engine operation, during which fuel flow provided by the fuel injectors is not necessarily analyzed. Engine 110 also is adapted for fuel injector testing operation, during which engine operation continues while fuel flow provided by the fuel injectors is analyzed. During fuel injector testing operation, the fuel supply line is altered by appropriate valving, including first valve means 150 in the fuel return line 127 for deadheading the fuel rail during fuel injector testing operation. Specifically, during testing operation valve means 150 closes the fuel return line to fuel flow from the fuel rail. During normal engine operation valve means 150 opens the fuel return line 127 to fuel flow from the fuel rail 124. Second valve means 155 is provided in fuel shunt line 131 for closing the fuel shunt line during normal engine operation and for opening the fuel shunt line during fuel injector testing operation. Since trapped vapor can seriously degrade the frequency response of the system, the system preferably is adapted to be purged. This occurs normally in the embodiment of FIG. 4 with valve 155 closed and valve 150 open. During normal engine operation, with first valve means 150 open and second valve means 155 closed, pressure in the fuel rail is regulated by pressure regulator 130 in fuel return line 127. During testing operation, with first valve means 150 closed to deadhead the fuel rail and second valve means 155 open, pressure is regulated by pressure regulator 160 in shunt line 131.

Fuel injector diagnosis in the embodiment of FIG. 4 is carried out substantially in accordance with the various techniques discussed above. Thus, timing signal 139 is sent by fuel injector control means 120 to signal processing means 137 to trigger measurement of a propagation delay period after which the signal processing means 137 conducts signal sampling of signal 135 from pressure sensor 134. In accordance with certain preferred embodiments, the actuation period sampling is done in the later (in time) portion of the pressure waveform trough to reduce complications involved in processing the initial higher frequency transients and to more closely estimate the steady-state level of the pressure drop.

As in the case of the embodiment of FIG. 2, the above-described waveform extraction method is preferred. By averaging multiple values of the pressure signal taken over the actuation sampling period initiated after the pressure wave propagation delay period, the signal processing means 137 determines an actuation value corresponding to an individual fuel injector. Averaging multiple values of the pressure signal taken over a non-actuation sampling period yields a non-actuation value. The signal processing means sends output signal 140 to the fuel injector control means 120 based on the difference between the actuation and the non-actuation value. In accordance with preferred embodiments, as discussed above, fuel injector control means 120 preferably employs memory means 142, such as a look-up table, to determine an adjustment factor for adjusting the duration of the actuation period for the fuel injector in question. Additional inputs 119 may also be fed to fuel injector control means 120 for determining actuation duration, for example, inputs from exhaust gas sensors, mass airflow sensors, etc.

Optionally, the system further comprises memory means 143 for storing a value corresponding to an acceptable fuel flow rate through each of the fuel injectors, and comparitor means for comparing an output signal from the signal processing means to the stored value. The stored value optionally may be the value of an initial output signal from the signal processing means for the injector in question. Alternatively, the stored value may be periodically updated or may be a fixed, preselected value. An operator signal 165 is generated when the comparison of an output signal to its corresponding stored value indicates an impaired injector. In the case of a motor vehicle engine, such operator signal may cause illumination of an instrument panel warning light or the like. Such operator signal can alert the operator to seek repair or replacement of the clogged injector(s) and/or to commence remedial maintenance, such as the use of detergent fuel or the like.

Those skilled in the art will recognize that the subject matter disclosed herein can be modified and/or implemented in alternative embodiments without departing from the true scope and spirit of the present invention as defined by the following claims.

We claim:

1. An internal combustion engine comprising:

fuel supply means for supplying liquid fuel under pressure to combustion cylinders of the engine, comprising at least one fuel injector operatively connected to a fuel rail;

fuel injector control means for individually actuating said at least one fuel injector to pass fuel from the fuel rail during a controlled actuation period; and an on-board diagnostic system for detecting impaired fuel injectors during engine operation, said on-board diagnostic system comprising:

pressure sensor means for sensing transient fuel pressure waves in the fuel rail resulting from actuation of the fuel injector and for generating pressure signals based thereon corresponding to fuel quantity passed by the fuel injector during actuation; and signal processing means for processing pressure signals from the pressure sensor means and for generating an output signal in response thereto.

2. The internal combustion engine of claim 1 further comprising memory means for storing a value corresponding to an acceptable fuel flow rate through said at least one fuel injector, and comparator means for comparing the output signal to the stored value.

3. The internal combustion engine of claim 1 wherein the pressure signals are generated by the pressure sensor means essentially in response to low frequency transient fuel pressure waves.

4. An internal combustion engine comprising:

fuel supply means for supplying liquid fuel under pressure to combustion cylinders of the engine, comprising at least one fuel injector operatively connected to a fuel rail;

fuel injector control means for individually actuating said at least one fuel injector to pass fuel from the fuel rail during a controlled actuation period; and an on-board diagnostic system for detecting impaired fuel injectors during engine operation, said on-board diagnostic system comprising:

pressure sensor means for sensing transient fuel pressure waves in the fuel rail resulting from actuation of at least one the fuel injector and for generating pressure signals based thereon corresponding to fuel quantity passed by the fuel injector during attuation; and signal processing means for processing pressure signals from the pressure sensor meads and for generating an output signal in response thereto, wherein the signal processing means is responsive to a timing signal from the fuel injection control means, averaging multiple values of the pressure signal taken during an actuation sampling period initiated after a predetermined pressure wave propagation delay period following the timing signal to yield an actuation value, averaging multiple values of the pressure signal taken during a non-actuation sampling period to yield a non-actuation value, and generating the output signal to the fuel injection control means based on the difference between the actuation value and the non-actuation value.

5. The internal combustion engine of claim 4 wherein the fuel injector control means is adapted to adjust the duration of the actuation period of the fuel injector in response to the output signal from the signal processing means.

6. The internal combustion engine of claim 4 wherein:

the fuel supply means comprises a plurality of said fuel injectors and further comprises a fuel pump operatively mounted to a fuel tank, a fuel supply line or passing fuel from the fuel pump to the fuel rail, and pressure regulator means operatively mounted to the fuel supply line proximate to the fuel pump for regulating fuel pressure in the fuel rail; and the fuel injector control means is adapted to actuate the fuel injectors, during a fuel injector test period:

in a standard mode wherein the fuel injectors are actuated in turn in a standard engine cycle sequence; and in a test mode wherein actuation of each of the fuel injectors is deleted in turn from a corresponding one of a series of otherwise standard engine cycle sequences to provide for each fuel injector a corresponding test cycle sequence in which it was not actuated; and the pressure signal for the actuation sampling period of each fuel injector is determined as the difference between the pressure signal for a standard engine cycle sequence and the pressure signal for the corresponding test cycle sequence.

7. The internal combustion engine of claim 6 wherein the pressure sensor means comprises a pressure transducer adapted to generate as the pressure signal an output voltage varying with pressure sensed in the fuel rail.

8. The internal combustion engine of claim 7 wherein the signal processing means comprises a waveform analyzer.

9. The internal combustion engine of claim 6 wherein the fuel rail is deadheaded.

10. The internal combustion engine of claim 6 adapted for normal engine operation, during which fuel flow provided by the fuel injectors is not analyzed, and for fuel injector testing operation, during which engine operation continues while fuel flow provided by the fuel injectors is analyzed, wherein the fuel supply line comprises a shunt line for returning excess fuel to the fuel tank, bypassing the fuel rail, said pressure regulator means being mounted in the shunt line for regulating fuel pressure in the fuel rail during the fuel injector testing operation and the fuel supply means further comprises:

a fuel return line for returning fuel from the fuel rail to the fuel tank;

first valve means in the fuel return line for deadheading the fuel rail during fuel injector testing operation by closing the fuel return line to fuel flow from the fuel rail, and for opening the fuel return line to fuel flow from the fuel rail during normal engine operation;

second valve means in the fuel shunt line for closing the fuel shunt line during normal engine operation and for opening the fuel shunt line during fuel injector testing operation; and second pressure regulator means mounted in the fuel return line for regulating fuel pressure in the fuel rail during normal engine operation, wherein the pressure sensor means is a pressure transducer mounted in fluid communication with the fuel rail for measuring low frequency transient pressure waves in the fuel rail caused by fuel injector actuation.

11. A method of detecting impaired fuel injectors in an internal combustion engine, said internal combustion engine comprising:

a plurality of said fuel injectors;

fuel supply means for supplying liquid fuel under pressure to the combustion cylinders of the engine, said fuel supply means comprising a plurality of fuel injectors operatively connected to a fuel rail;

fuel injector control means for individually actuating the fuel injectors to pass fuel from the fuel rail during a controlled actuation period;

pressure sensor means for sensing transient fuel pressure waves in the fuel rail resulting from actuation of individual fuel injectors and for generating pressure signals based thereon corresponding to fuel quantity passed by the fuel injectors during actuation; and signal processing means for processing pressure signals from the pressure sensor means and for generating an output signal in response thereto;

said method comprising the steps of:

actuating the fuel injectors during a fuel injector test period in a standard mode wherein the fuel injectors are actuated in turn in a standard engine cycle sequence, and in a test mode wherein actuation of each of the fuel injectors is deleted in turn from a corresponding one of a series of otherwise standard engine cycle sequences to provide for each fuel injector a corresponding test cycle sequence in which it was not actuated;

generating a standard pressure signal in response to the standard engine cycle sequence and a test pressure signal for each fuel injector in response to the corresponding test cycle sequence;

determining a fuel flow value for each fuel injector, individually, corresponding to fuel quantity passed during its actuation period by comparing the standard pressure signal and the test pressure signal to each other; and passing the output signal for each fuel injector to the fuel injector control means and adjusting the actuation period of the fuel injector based thereon.

12. The method of claim 11 further comprising the step of comparing the fuel flow value for each fuel injector, individually, to a stored reference value to identify which, if any, of the fuel injectors is an impaired fuel injector, and generating an operator signal if an impaired fuel injector is identified.

13. The method of claim 11 wherein the signal processing means comprises a waveform analyzer and the output signal to the fuel injector control means for each impaired fuel injector indicates its degree of impairment and the actuation period of each impaired fuel injector is increased an amount corresponding to its degree of impairment.

* * * * *